US007338327B2

(12) United States Patent
Sticker et al.

(10) Patent No.: US 7,338,327 B2
(45) Date of Patent: Mar. 4, 2008

(54) COUPLING

(75) Inventors: Rolf Sticker, Donaueschingen (DE); Stefanie Berger, Blumberg-Fützen (DE); Gerd Philipp, Böblingen (DE); Andreas Schumann, Steinenbronn (DE)

(73) Assignee: MC Technology GmbH, Blumberg (DE)

( * ) Notice: Subject to any disclaimer, the term of this patent is extended or adjusted under 35 U.S.C. 154(b) by 0 days.

(21) Appl. No.: 11/657,117

(22) Filed: Jan. 24, 2007

(65) Prior Publication Data

US 2007/0212947 A1 Sep. 13, 2007

(30) Foreign Application Priority Data

Jan. 25, 2006 (DE) ..... 10 2006 003 752

(51) Int. Cl.
*H01R 25/00* (2006.01)

(52) U.S. Cl. ..... 439/638

(58) Field of Classification Search ..... 439/638, 439/676, 540.1, 67, 607, 620, 344, 354; 29/884, 29/883; 174/52 FR
See application file for complete search history.

(56) References Cited

U.S. PATENT DOCUMENTS 4,153,327 A * 5/1979 Johnson ..... 439/344
4,273,402 A * 6/1981 Hughes ..... 439/344
4,379,609 A * 4/1983 Hardesty ..... 439/344
4,460,234 A * 7/1984 Bogese ..... 439/557
4,593,966 A * 6/1986 Meyer ..... 439/595
4,799,901 A * 1/1989 Pirc ..... 439/620.15
4,806,117 A * 2/1989 Johnston ..... 439/344
4,817,283 A * 4/1989 Johnston et al. ..... 29/884
4,817,285 A * 4/1989 Olejniczak ..... 30/47
4,904,204 A * 2/1990 Heng et al. ..... 439/425
5,454,737 A * 10/1995 Saba ..... 439/655
6,113,432 A * 9/2000 Liao ..... 439/638
6,354,883 B2 * 3/2002 Jaing ..... 439/676
6,736,670 B2 * 5/2004 Clark et al. ..... 439/540.1
6,736,680 B2 * 5/2004 Slack et al. ..... 439/676
6,976,877 B2 * 12/2005 Lien ..... 439/620.01
7,048,550 B2 * 5/2006 Hyland et al. ..... 439/67
7,066,771 B2 * 6/2006 Clark et al. ..... 439/676
7,134,915 B1 * 11/2006 Tsai ..... 439/620.01
7,241,182 B2 * 7/2007 Clark et al. ..... 439/676

FOREIGN PATENT DOCUMENTS

DE 10 2004 022 865 A1 12/2005

* cited by examiner

*Primary Examiner*—Alexander Gilman
(74) *Attorney, Agent, or Firm*—The Nath Law Group; Jerald L. Meyer; Derek Richmond

(57) ABSTRACT

A coupling with two sleeves facing in opposite directions for the plugs of two shielded data cables that are to be connected to each other is in particular configured as an RJ 45 coupling. A printed circuit board (10) carries a contact assembly for each of the sleeves and connects the corresponding contacts (12) with each other. Two partial shells (14) made of an electrically insulating material envelop and hold the printed circuit board (10). An electrically conductive housing (40) is essentially U-shaped, with its longitudinal axis extending in the plug-in direction of the sleeves. The partial shells (14), together with the printed circuit board (10) they envelop, are insertable in the housing (40) as modules and can be attached firmly in the housing (40). An electrically conductive sheet metal cover (60) covers the modules on the open side of the housing (40) and engages with molded contacting prongs (62) in the sleeves for the purpose of contacting the shields of the plugs inserted into the sleeves.

17 Claims, 2 Drawing Sheets

COUPLING

Figure 1:
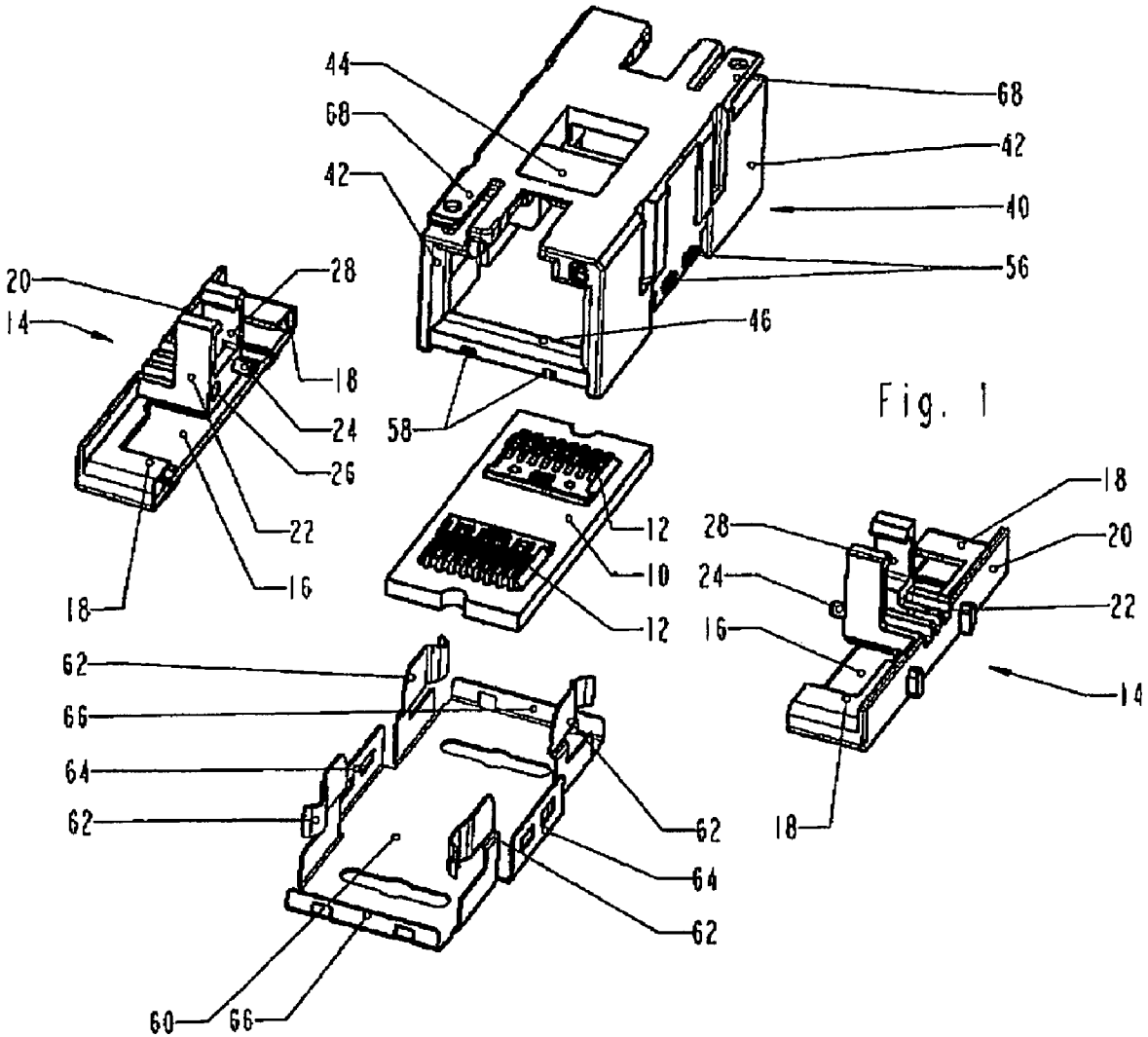

This invention concerns a coupling with two sleeves facing in opposite directions for the plugs of two shielded data cables that are to be connected to each other.

Structured building cables and internal data networks, e.g. Ethernet networks, are increasingly connected to industrial wiring. This requires an interface between the network and the industrial wiring to be established. Connector couplings are used for this purpose to connect the data cables of the network with the data cables of the industrial application. These couplings are nowadays usually configured as RJ 45 connectors. The industrial environment and the environment of the data network are usually separated from each other by means of a dividing wall, e.g. by a housing wall. To achieve the coupling through such a partition with the required high degree of protection, e.g. according to IP 67, industrial flanges, which provide for a sufficiently good seal and in which the coupling is built in, are installed in the partition. Various standards exist for these industrial flanges so that difficulties can arise if the coupling cannot be installed in the industrial flange because of its size.

It is the purpose of this invention to provide a coupling which is, on the one hand, sufficiently durable for use in an industrial environment and whose dimensions are, on the other hand, sufficiently small to allow the coupling to be built into various industrial flanges.

This task is accomplished according to this invention via a coupling with the characteristics of Claim 1.

Advantageous embodiments of this invention are provided by the secondary claims.

The coupling comprises two sleeves accommodating the plugs of the data cables that are to be interconnected, with the socket connection in most applications nowadays being configured as an RJ 45 socket connection. The coupling has the shape of an elongated cuboid at each front end of which the sleeves are located, so that the two sleeves align with each other in the longitudinal direction of the coupling and have opposing plug directions. The coupling contains a printed circuit board which carries the two contact assemblies for the socket connections and which interconnects corresponding contacts of these two contact assemblies with each other via printed circuit paths. The printed circuit board fits into two partial shells made of an insulating plastic which, on one hand, insulate the printed circuit board electrically and, on the other hand, stabilize the printed circuit board against mechanical stress. The partial shells along with the printed circuit board enclosed by them constitute a module which is installed in a housing. The housing is electrically conductive and is preferably made of metal. Specifically, the housing can be made as a die-cast metal part, preferably as a die-cast zinc part. The housing is U-shaped and thus constitutes the three long sides of the cuboid-shaped coupling. The module with the printed circuit board installed in the housing is covered on the fourth, open long side of the housing by an electrically conductive sheet metal cover. The housing together with the sheet metal cover forms a shield which encloses the coupling on all four long sides and only leaves the two front ends with the socket openings of the sleeves open to the plugs that are to be connected.

Contacting prongs, each of which penetrate into the interior of the sleeves and which contact the shield of the plugs inserted into the sleeves, are installed on the sheet metal cover. The sheet metal cover interconnects the shielding of the plugs inserted into the coupling directly, so that the plug contacts and the conducting paths of the printed circuit board connecting them are covered by a metallic shield that is enclosed on all sides.

A simple and economical production and assembly are preferably achieved by designing the partial shells accommodating the printed circuit board as identical half shells. In order to accommodate it, these can be rotated by 180° with respect to each other and slid from the two longitudinal edges onto the printed circuit board. The two partial shells advantageously abut along a longitudinal center plane and are joined in an appropriate manner so that the module consisting of the partial shells and the printed circuit board is held together sufficiently well for further assembly.

This module together with the sheet metal cover is advantageously installed in the housing from the open long side and can advantageously be locked into the housing. For this purpose, a locking device is for example located in the longitudinal center of the housing, i.e. between the two sleeves. The sheet metal cover can also be advantageously interlocked with the housing, so that the entire coupling is assembled via interlocking connections only. This makes a simple and fast assembly possible that does not require additional assembly tools.

The cross sectional dimensions of the coupling are essentially determined by the cross section of the plug contour of the sleeves. This plug contour is enclosed only by the housing which acts as a shield.

This results in minimum cross sectional dimensions for the coupling so that the coupling can be installed in various standard industrial flanges. The housing and the partial shells stabilizing the printed circuit board ensure a robustness of the coupling which is appropriate for the greater mechanical stress in industrial applications. Since the printed circuit board and the plug contacts are shielded on all sides, strong protection of the coupling against interference is also ensured.

This invention is hereafter described in greater detail using an example embodiment shown in the drawings, which show:

FIG. 1 an exploded view of the coupling and

Figure 2:
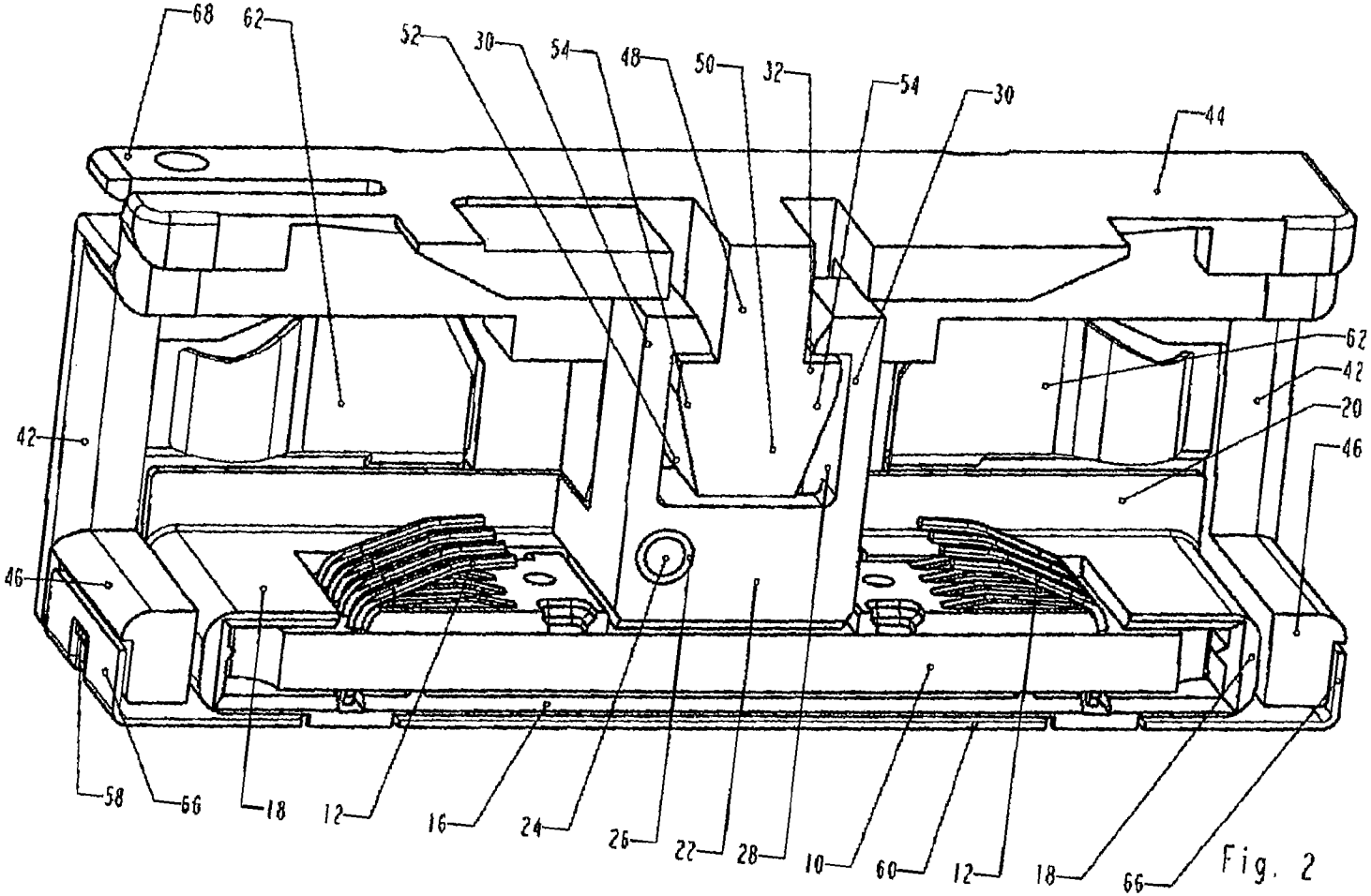

FIG. 2 a vertical section through the coupling in the axial center plane.

The example embodiment shows a coupling which serves the purpose of connecting two shielded data cables via RJ 45 socket connections. The coupling has the overall shape of an elongated cuboid on whose two front ends there is an RJ 45 sleeve to accommodate the RJ 45 plugs, each of which is connected to data cables. The two sleeves are axially aligned with each other facing in opposite plug-in directions.

The coupling contains a printed circuit board 10, which carries the contacts 12 of the two sleeves. The contacts 12 are configured as contact springs which are imprinted on the printed circuit board 10. In the design shown with RJ 45 socket connections, a corresponding number of 8 contacts 12 are provided for each sleeve. The contacts 12 of the two sleeves corresponding to each other are connected to each other via printed circuit paths of the printed circuit board 10.

The printed circuit board 10 fits into two partial shells 14. The partial shells 14 are designed identically and are slid from the two longitudinal edges of the printed circuit board 10 onto the printed circuit board 10 so that each of the two partial shells 14 accommodates half of the printed circuit board 10. The partial shells 14 have a frame 16 at the bottom end which fits the underside of the printed circuit board 10. A U-shaped pocket 18, into which the respective front end of the printed circuit board 10 is slid, is molded pointing upward onto the two front ends of the partial shell 14. With these pockets 18, the partial shells 14 grip the respective front ends of the printed circuit board 10 so that the printed circuit board is held in the partial shells 14. An upward-bent longitudinal edge 20 of the partial shells 14 serves the purpose of a stop when the partial shells 14 are slid onto the printed circuit board 10 and covers the longitudinal ends of the printed circuit board 10 on the outside. In the longitudinal center of the partial shells 14, a bridge 22, which runs crosswise above the frame 16, is positioned at the upper edge of the longitudinal end 20. A gap whose vertical width corresponds to the height of the printed circuit board 10 remains open between the frame 16 and the bridge 22. If the partial shells 14 are slid from their two respective long sides onto the printed circuit board 10, the frames 16 rest against the underside of the printed circuit board 10 and the bridges 22 slide between the contacts 12 and over the top of the printed circuit board 10. In the longitudinal central axis of the coupling, the two slid-on partial shells 14 abut against each other flush, on the one hand with the internal longitudinal end of the frame 16 and on the other hand with the two inner surfaces of their respective bridges 22. A pin 24 and a bore 26 are molded onto the inner surface of each bridge 22. Since the two partial shells 14 are slid onto the printed circuit board 10 rotated at 180° with respect to each other, the pin 24 of one bridge 22 is engaged by the bore 26 of the other bridge. The partial shells 14 enclosing the printed circuit board 10 are thus firmly joined.

The partial shells 14 consist of an electrically insulating material, in particular made of plastic and are preferably produced in a single piece as plastic, injection-molded parts. The joined partial shells 14, together with the printed circuit board 10 they enclose, constitute a compact module for the assembly of the coupling. The partial shells 14 insulate the printed circuit board 10 electrically and reinforce the printed circuit board 10 against mechanical stress, in particular against a bending stress.

The coupling furthermore comprises a housing 40 that is electrically conductive. The housing 40 preferably consists of metal and is in particular a die-cast metal part, preferably a die-cast zinc part.

The housing 40 has the form of a U-shape extending in the plug-in direction of the coupling and forms the sides with its legs 42 and the top of the coupling with its yoke 44. At the two front ends of the housing 40, the free ends of the legs 42 are connected by a transverse bar 46 serving the purposes of reinforcing the housing 40.

The free underside of the housing 40 is covered by an electrically conductive sheet metal cover 60. The sheet metal cover 60 is preferably a punch-bent sheet metal part.

The module consisting of the partial shells 14 and the printed circuit board 10, together with the sheet metal cover 60, is inserted into the housing 40 from the free underside and locks into the housing 40.

For this purpose, a locking bar 48 protruding inward and extending crosswise is molded onto the longitudinal center of the housing 40 on the inside of the yoke 44, ending in a broadened head 50. The head 50 is designed with receiving bevels 52 at its free interior end and forms laterally projecting detents 54 above the locking bar 48. When modules are inserted into the housing 40, the head 50 is pressed into a mounting 28 molded onto the top of the bridges 22. The mounting 28 has movable spring-loaded locking hooks 30 at its top which are configured with receiving bevels 32. When the head 50 is pressed into the mounting 28, the locking hooks 30 are first pried apart by the effect of the receiving bevels 52 of the head 50 on the receiving bevels 32 of the locking hooks 30 until the head 50 has penetrated into mounting 28. The spring-loaded rest hooks 30 then jump behind the detents 54 of the head 50 so that the partial shells 14 and thus the module enclosing the entire printed circuit board 10 locks into the housing 40, as shown in FIG. 2.

The dimensions of the sheet metal cover 60 correspond to the dimensions of the lower sides of the housing 40. The sheet metal cover 60 covers the partial shells 14 accommodated in the housing 40 and the printed circuit board 10 at the bottom of the housing 40. At the two longitudinal sides of the sheet metal cover 60, two prongs 62 are located which are curved upward vertically to the level of the sheet metal cover 60.

The free ends of the prongs 62 are bent at right angles in the plug-in direction of the coupling.

On insertion of the modules consisting of the partial shells 14 and the printed circuit board 10 and the sheet metal cover 60 into the housing 40, the sheet metal cover 60 closes the bottom of the housing 40 and the contacting prongs 62 pass in between the longitudinal ends 20 of the partial shells 14 and the legs 42 of the housing 40, so that the bent free ends of the contacting prongs 62 are exposed on the internal side walls of the sleeves for lateral spring-loaded coupling.

Furthermore, locking links 64 are bent upward at right angles at the longitudinal ends of the sheet metal cover 60 and locking brackets 66 at the transverse front ends of the sheet metal cover 60. On insertion of the sheet metal cover 60 into the housing 40, the locking links 64 with punched-out openings grab the locking projections 56, which are molded outside onto the lower edge of the legs 42 of the housing 40. The locking links 66 with punched-out openings lock onto locking projections 58, which are respectively located at the front end of the transverse bars 46 of the housing 40. The sheet metal cover 60 is thus firmly locked onto the housing 40.

In the assembled coupling, the housing 40 with the sheet metal cover 60 forms a shielding closed on the four sides of the coupling. At the front ends the housing 40 forms the respective socket openings for the plugs with the transverse bars 46. The inner walls of the sleeves are formed by the yoke 44 of the housing 40 at the top, by the partial shells 14 and the contacts 12 at the bottom and by the contacting prongs 62 of the sheet metal cover 60 at both internal side walls. An inserted plug comes into contact with the contacts 12. The prongs 62 attach flexibly from the outside to the external shielding of the inserted plugs, so that the shielding of both inserted plugs are directly conductively connected with each other via the contacting prongs 62 and the sheet metal cover 60.

An external contact 68 through which the housing 40 can be grounded is located at the two front ends of the yoke 44 of the housing 40. The external contacts 68 are respectively formed as flat plug-in tongues of one piece with the housing 40, are located in a recess of the outer contour of the housing 40 and respectively point toward the plug-in direction of the sleeves. The external contacts 68 and possibly the cable lugs attached to them do not increase the cross section of the coupling.

The printed circuit board 10, the partial shells 14, the housing 40 and the sheet metal cover 60 can be assembled without additional tools by simply putting them together and interlocking them. The external cross sectional dimensions of the coupling are essentially determined by the cross section of the sleeves. The interlocking of the individual components occurs within the cross section of the housing 40 enclosing the sleeves so that the external cross section is not increased by additional assemblies. The coupling with minimum outer dimensions can therefore be inserted into any number of industrial flanges. The die-cast metal housing 40 and the stabilization of the printed circuit board 10 by the enclosing partial shells 14 ensure a high robustness of the coupling for application in an industrial environment.

REFERENCE SYMBOL LIST

10 Printed circuit board
12 Contacts
14 Partial shells
16 Frame
18 Pocket
20 Longitudinal end
22 Bridge
24 Pin
26 Hole
28 Mounting
30 Locking hook
32 Receiving bevels
40 Housing
42 Leg
44 Yoke
46 Transverse bars
48 Locking bar
50 Head
52 Receiving bevels
54 Detents
56 Locking projections
58 Locking projections
60 Sheet metal cover
62 Contacting prongs
64 Locking brackets
66 Locking brackets
68 External contact.

The invention claimed is:

1. Coupling with two sleeves facing in opposite directions for plugging two shielded data cables that are to be connected to each other, with a printed circuit board (10) carrying a contact assembly for each of the sleeves and connecting conductively the corresponding contacts (12) of the contact assemblies with each other, with two partial shells (14) made of an electrically insulating material, which envelop and hold the printed circuit board (10), with an electrically conductive housing (40) which essentially has the shape of a U- profile whose longitudinal axis extends in the plug-in direction of the sleeves and which leaves the socket openings of the sleeves at both of its front ends exposed, with the partial shells (14), along with the printed circuit board (10) they enclose, being insertable into the housing (40) as a module and attachable to the housing (40), and with a conductive sheet metal cover (60) covering the modules at the open profile side of the housing (40) and fitting into the two sleeves with molded contacting prongs (62) for the purpose of contacting the shielding of the plugs inserted into the sleeve.

2. Coupling according to claim 1, wherein the free ends of the legs (42) of the housing (40) are connected at their front ends by a transverse bar (46).

3. Coupling according to claim 1, wherein the housing (40) is a die-cast metal part, in particular a die-cast zinc part.

4. Coupling according to claim 1, wherein the partial shells (14) can be slid onto the printed circuit board (10) at the two long sides.

5. Coupling according to claim 4, wherein the partial shells (14) abut each other and are joinable at the butt joint.

6. Coupling according to claim 5, wherein the two partial shells are identical (14) and are slid onto the printed circuit board (10) at a 180° rotation against each other.

7. Coupling according to claim 1, wherein the partial shells are lockable (14) into the housing (40).

8. Coupling according to claim 7, wherein a locking device (28, 50) for the housing (40) and the partial shells (14), which engages when the partial shells (14) are inserted into the open side of the housing (40), is mounted centrally between the sleeves.

9. Coupling according to claim 1, wherein the respective partial shells (14) enclose the printed circuit board (10) at its front ends.

10. Coupling according to claim 1, wherein the sheet metal cover (60) covers the open side of the housing (40) completely and together with the latter forms a completely closed shield.

11. Coupling according to claim 1, wherein the sheet metal cover (60) is lockable to the housing (40) with locking brackets (64, 66) that are bent upward at the edges.

12. Coupling according to claim 1, wherein the contacting prongs (62) of the sheet metal cover (60) pass to the sleeves between the legs (42) of the housing (40) and the longitudinal edges (20) of the partial shells (14).

13. Coupling according to claim 1, wherein the contacts (12) are formed by contact springs pressed into the printed circuit board (10).

14. Coupling according to claim 1, wherein the sleeves and the plugs are configured as RJ 45 connectors.

15. Coupling according to claim 1, wherein at least one external contact (68) for an external conductor is located on the external surface of the housing (40).

16. Coupling according to claim 15, wherein the external contact (68) is molded as one piece onto the housing (40).

17. Coupling according to claim 15, wherein the external contact (68) is a flat tongue, which preferably lies within the outer contour of the housing (40) and points in the plug in direction.

* * * * *